US011255178B2

(12) United States Patent
Kanstad et al.

(10) Patent No.: US 11,255,178 B2
(45) Date of Patent: Feb. 22, 2022

(54) SUBSEA SPLITTER PUMP SYSTEM

(71) Applicant: OneSubsea IP UK Limited, London (GB)

(72) Inventors: Stig Kåre Kanstad, Fana (NO); Helge Dale, Rådal (NO)

(73) Assignee: OneSubsea IP UK Limited, London (GB)

( * ) Notice: Subject to any disclaimer, the term of this patent is extended or adjusted under 35 U.S.C. 154(b) by 9 days.

(21) Appl. No.: 16/579,905

(22) Filed: Sep. 24, 2019

(65) Prior Publication Data

US 2020/0095857 A1 Mar. 26, 2020

Related U.S. Application Data

(60) Provisional application No. 62/735,217, filed on Sep. 24, 2018.

(51) Int. Cl.

| | |
|---|---|
| ***E21B 43/40*** | (2006.01) |
| ***E21B 21/12*** | (2006.01) |
| ***E21B 43/36*** | (2006.01) |

(52) U.S. Cl.

CPC ..... *E21B 43/40* (2013.01); *E21B 21/12* (2013.01); *E21B 43/36* (2013.01)

(58) Field of Classification Search

CPC ..... E21B 43/01; E21B 43/36; E21B 43/38; E21B 43/385; E21B 43/40; E21B 21/12

See application file for complete search history.

(56) References Cited

U.S. PATENT DOCUMENTS

| | | | | |
|---|---|---|---|---|
| 9,463,424 | B2 | 1/2016 | Kaare et al. | |
| 2004/0245182 | A1* | 12/2004 | Appleford | E21B 43/121 210/739 |
| 2016/0010433 | A1* | 1/2016 | Kanstad | B01F 5/0689 166/366 |
| 2016/0138595 | A1 | 5/2016 | Becquin et al. | |
| 2016/0138762 | A1* | 5/2016 | Becquin | F17D 1/065 137/1 |
| 2016/0290331 | A1* | 10/2016 | Bibet | E21B 43/0107 |
| 2019/0169968 | A1 | 6/2019 | Kaare et al. | |

* cited by examiner

*Primary Examiner* — David Carroll
(74) *Attorney, Agent, or Firm* — Eileen Pape

(57) ABSTRACT

A system for recirculating a portion of a liquid fraction of multiphase production fluid to a pump for enhanced functionality thereof. The system includes a splitter assembly that obtains the multiphase production fluid from the pump. The splitter assembly utilizes multiple internal chambers to separate gas and liquid fractions of the fluid. A portion of the liquid fraction may then be recirculated back to the pump as indicated whereas the remainder of the liquid fraction may be recombined with the gas fraction for production.

19 Claims, 6 Drawing Sheets

SUBSEA SPLITTER PUMP SYSTEM

BACKGROUND

Exploring, drilling and completing hydrocarbon and other wells are generally complicated, time consuming and ultimately very expensive endeavors. This is particularly true in the case of offshore operations where expenses may grow exponentially long after the completion of the well. For example, subsequent routing intervention and maintenance may require considerable more time, effort and cost at the subsea oilfield.

In recognition of these potentially enormous expenses, added emphasis has been placed on well monitoring and maintenance throughout the life of an oilfield. Maintaining production from a host of wells at a subsea oilfield often requires the use of pumping to aid in recovery of production fluids. Along these lines, a host of multiphase pumps are generally incorporated into the layout of the field.

Pumps may be used to enhance production by reducing wellhead pressure to allow a more rapid depletion and to lift weak wells in concert with production flow from stronger wells. Multiphase pumps are also used in the field layout due to the often inconsistent or changing nature of the production fluids. That is, produced fluids may be a mixture of liquid and gas. Often such a fluid mixture is referenced in terms of its gas volume fraction (GVF). So, for example, a production fluid that is 5% gas may be noted as having a 5% GVF. Regardless, a multiphase pump may be configured to effectively pump such fluid mixtures. In many cases produced fluids from subsea fields are substantially liquid at the outset with the GVF rising over time to reach 60%, 90% or higher. Of course, this is not universally the case and there may be periods of high GVF at the outset of production or for intermittent periods over the life of any well.

Regardless of when high GVF is presented, recovery of production fluids will be more of a challenge as GVF rises. This is because in order to attain effective pumping assistance, even with a multiphase pump, the production fluid should consist of a sufficient liquid fraction in order to support a substantial differential pressure. By way of example, a conventional multiphase pump presented with production fluids having a negligible GVF might attain a 180 bar differential and pump at 5,000 rpm for substantial production assistance. However, as the GVF rises, the differential pressure that the pump is able to generate diminishes. More specifically, as a practical matter, once the GVF reaches 30-60%, the assistance provided by the pump is largely inefficient. By the time the GVF reaches 90% or more, no real pumping assistance is available.

Alternative forms of production assistance may be available. For example, rather than attempting to inefficiently continue pumping when a GVF of 60% emerges, artificial gas lift may be utilized. This technique involves introducing pressured gas down through the well annulus to reach the bottom of the well and thereby ultimately effecting production out of the well.

Unfortunately, utilizing gas lift as described, requires dedicating a host of other new resources to the site. A gas source is required as well as the equipment necessary to supply the gas and at sufficient pressure. Once more, not only is a new gas fluid introduced but it will also need to be collected and processed at a later point in time along with all other production fluids. Further, this entirely new circulation system of artificial gas lift may be utilized in the face of a high GVF that might turn out to be only temporary. That is, as noted above, while GVF often increases over the life of a field, this is not always so. Once more, predicting GVF can be more of an art. This means that the economic burden of gas lift measures are often unnecessarily, or at least prematurely, resorted to when conventional lower cost pumping assistance would have turned out to be sufficient.

Of course, the alternative of delaying the introduction of gas lift or other less cost effective assistance may also have a downside. If gas lift hardware is provided to the field and available, how long should the operator continue to delay such assistance when the GVF has rendered multiphase pumping assistance inefficient? Even if this could be ascertained with a degree of certainty, what of the cost incurred in making sure that the gas lift hardware is incorporated into the field and a ready supply of gas and other equipment made available? At present, with no guarantee of continued pumping assistance being available once GVF reaches a certain point, these unknowns continue to remain a substantial burden for operators.

SUMMARY

A pump system for use at a subsea oilfield is disclosed. The system includes a multiphase pump in communication with a well at the oilfield. A splitter assembly is in fluid communication with an outlet of the pump and includes multiple outlets. A production outlet of the splitter assembly is provided for producing fluid from the well and a recirculation outlet is also provided for diverting pumped fluid back to the pump for increasing a pressure differential to enhance pump capacity.

DETAILED DESCRIPTION

In the following description, numerous details are set forth to provide an understanding of the present disclosure. However, it will be understood by those skilled in the art that the embodiments described may be practiced without these particular details. Further, numerous variations or modifications may be employed which remain contemplated by the embodiments as specifically described.

Embodiments are described with reference to certain types of subsea oilfield layouts utilizing permanently installed subsea pumps at the seabed to facilitate continuous production from wells of the oilfield. However, no particular layout is required. For example, the system and techniques described herein may be directed at a single well or even utilized in a surface environment. So long as a splitter assembly is available to recirculate liquid fluid back to the pump during pumping operations for reducing the GVF within the pump itself to ensure continued pumping function, appreciable benefit may be realized.

Figure 1:
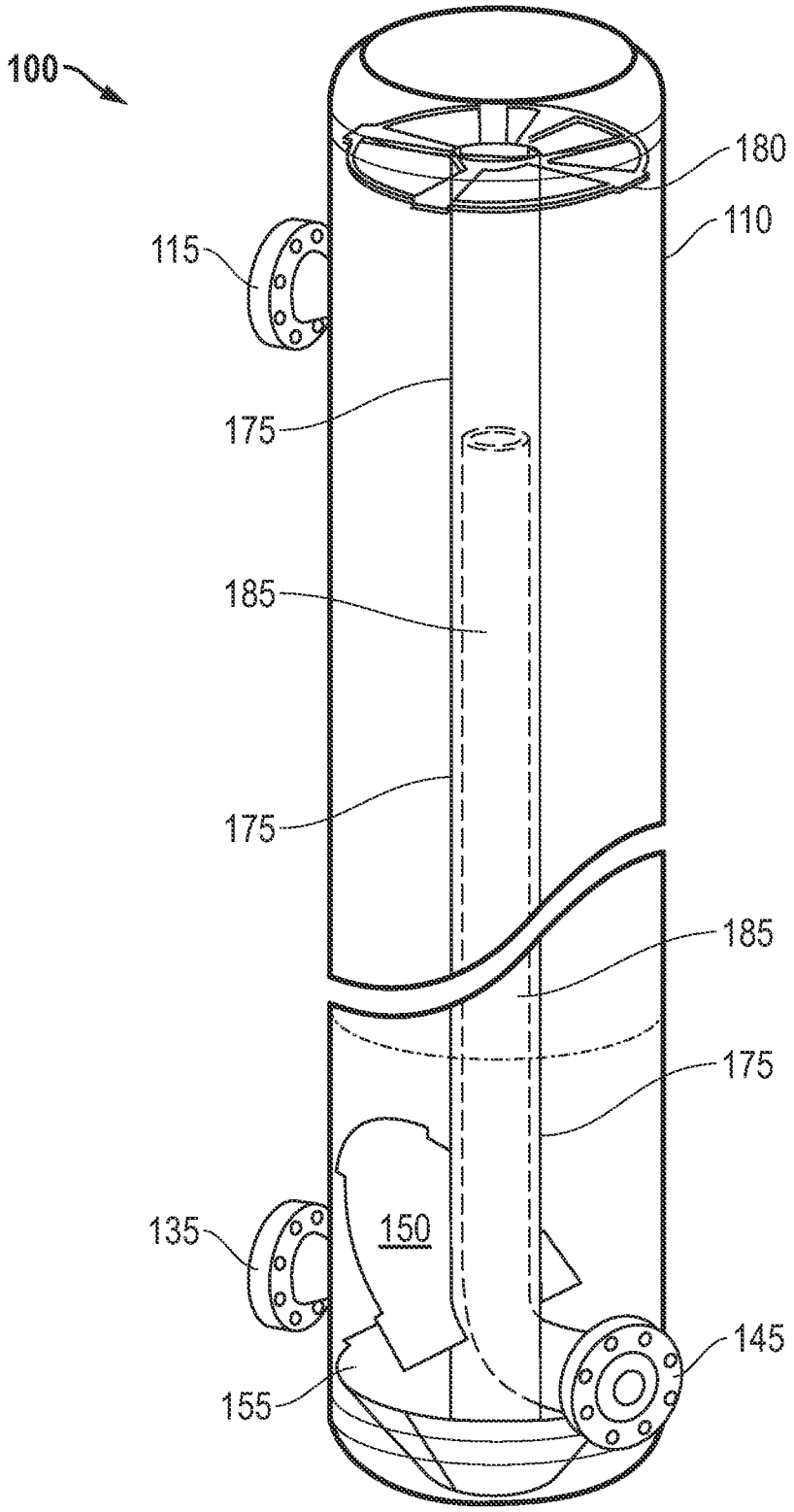
FIG. 1 is a perspective sectional view of an embodiment of a splitter assembly of a subsea pump system.

Referring now to FIG. 1, a perspective sectional view of an embodiment of a splitter assembly 100 is shown. With added reference to FIGS. 2B and 3, the assembly 100 is for use with a subsea pump system 200. Specifically, an inlet 115 is fluidly coupled to a multiphase pump 250, which may be of a type often utilized at a subsea oilfield 301. However, as suggested, to help ensure continuous pumping aid to production even in the face of high GVF, production fluids are routed through the splitter assembly 100, initially via the inlet 115 as indicated.

Once reaching the interior of the assembly 100, production fluids are faced with a multi-tiered flow path. That is, given that the production fluid is often a mixture of liquid and gas, sometimes with a high GVF, the splitter assembly 100 is configured to "split" away the gas of the fluid and recirculate a portion of the liquid fraction back to the pump 250 (see FIG. 2B). This is achieved by way of the noted multi-tiered flow path which allows for liquid production fluid to return to the pump 250 of FIG. 2B by way of a recirculation outlet 135.

Figure 2B:
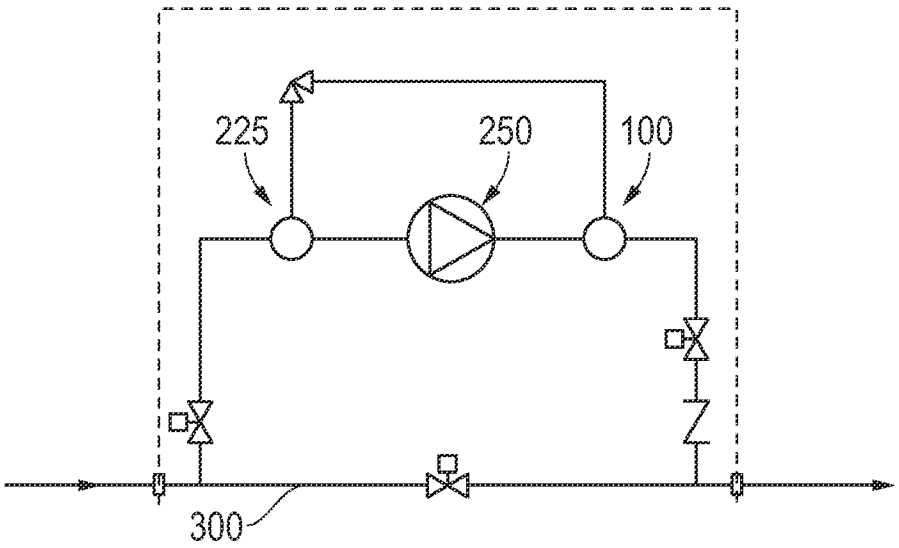
FIG. 2B is a schematic representation of a subsea pump system utilizing the splitter assembly of FIG. 1 with a multiphase pump.
Figure 2A:
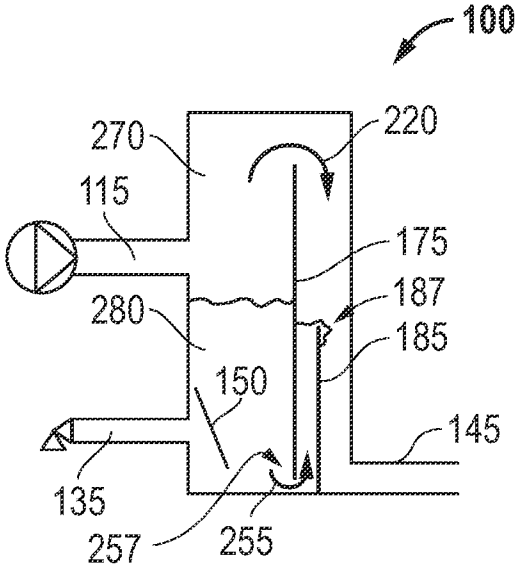
FIG. 2A is a schematic representation of the splitter assembly of FIG. 1 during pumping operations.

Continuing with reference to FIGS. 1 and 2A, production fluid enters the splitter assembly 100 via the inlet 115 at a location above the noted outlet 135. Thus, the fluid is presented with a chamber that effectively allows the fluid types to split with the liquid fraction 280 falling below the gas fraction 270. This is readily illustrated in the schematic of FIG. 2A. With specific reference to FIG. 1, this initial chamber is defined by the assembly housing 110. An outer chamber or tube 175 is open at the top but secured by a circumferential support mechanism 180 to the inner side of the housing 110.

Note that the liquid 280 of the production fluid which falls to the lower portion of the assembly 100 is allowed to escape either through continued production flow (arrow 255) or through the outlet 135 as indicated above. Of course, with operations focused on ultimately obtaining production fluids, allowing the liquid 280 to continue along the production flow path is understandable. However, keeping the pump 250 of FIG. 2B running may be key in this regard. Thus, to ensure a sufficient priming liquid supply to the pump 250 for continued pump assistance, a portion of the liquid fraction 280 is also recirculated through the outlet 135 and back to the pump 250 as described. In certain embodiments, additional liquids may be introduced with the priming such as methanol, monoethylene glycol or other conventional chemical injection liquids to reduce startup time, for cooling purposes and/or to add to the liquid level at the pump.

As illustrated, the lower portion of the assembly 100 includes a deflector 150. The deflector 150 is a shield plate that deflects sand and debris of the production fluid such that the liquid directed through the outlet 135 and back over to the pump 250 is more free of unhelpful particulates. In this way, priming liquid support for continued pump function may be further enhanced (see FIG. 2B). That is, while the production fluid on the whole may be of a GVF that is too high to support a sufficient differential for effective pumping, the pump 250 is not pumping production fluid on the whole. Rather, the pump 250 is pumping production fluid mixed with recirculated liquid of the production fluid, thereby reducing the GVF and allowing for continuous priming for continuous pump function.

With specific reference to FIG. 2A, incoming production fluid faces a low pressure drop with exposure to the comparatively large volume of the housing 110. Thus, liquid collects at the bottom of the assembly 100 where it pools until a level between the tubes 175, 185 exceeds the height of the inner tube 185. At this point, this portion of the liquid begins to spill over 187 as described here. This result is what is often referred to as a "Weir" effect. That is, an accumulation of liquid at the base of one or more barriers is presented without halting fluid flow. This Weir effect and splitting of the multiphase fluid may occur to the benefit of continued pump function as detailed herein.

In the embodiment shown, the inner tube 185 governs the Weir effect as noted which aids in re-mixing of gas 270 and liquid 280. That is, the production fluid is to be collected and not merely recirculated. Thus, the inner tube 185 is also configured to allow liquid production to continue along a production flow path (see arrow 255). However, the inner tube 185 serving as a Weir-type barrier also helps to ensure sufficient pooling of the liquid production 280 for recirculation as noted above and illustrated in FIG. 2A. So, for example, unlike the outer tube 175, the inner tube 185 is fully secured and sealed at the base 155 of the assembly 100. Alternatively, the outer tube 175 includes an opening 257 at the bottom that allows for fluid communication with the inner tube 185. The opening 257 is restricted in size and positioned below the vertical position of the recirculation outlet 135. Thus, as the production fluid enters the assembly 100 and the pooling liquid 280 develops, it is afforded ample opportunity to exit through either the outlet 135 or the opening 257.

As illustrated, the inner tube 185 is shorter than the outer tube 175 to ultimately facilitate liquid spill over 187 in the direction of production flow toward the production outlet 145 of the assembly 100. Similarly, the inner tube 185 avoids presenting any barrier to gas flow (see arrow 220). Thus, with the exception of the portion of the pooled liquid that is diverted through the recirculation outlet 135, all of the production fluid that advances into the assembly 100 further advances in the noted direction of production flow toward the production outlet 145.

As noted above, the deflector 150 may encourage unhelpful particulate toward a base 155 and away from recirculation. The base 155 may be cup shaped to encourage collection of particulate thereat as illustrated in FIG. 1. As production continues via the production outlet 145, this particulate may be produced with other produced fluids.

Referring specifically now to FIG. 2B, a larger schematic representation of the subsea pump system 200 that utilizes the splitter assembly 100 of FIG. 1 is shown. The assembly 100 is coupled to the pump 250 as discussed above. However, in the embodiment shown, recirculated liquid production is initially directed toward a mixer 225 and combined with production fluids drawn from the oilfield before reaching the multiphase pump 250. Thus, the GVF of the production fluid is beneficially altered before reaching the pump 250 as described above. As with conventional circulation, use of a mixer 225 may also dampen severe slugging and help ensure an equitable split of flow among pumps where multiple pumps are utilized. Note that the flow of production fluid 300 proceeds along a production line with a portion of the fluid diverted to the mixer 225 and/or splitter 100 as described above before being returned to the line for continued advancement and eventual collection. In this way, the subsea pump system 200 is effectively a system that has been coupled to a standard production line to facilitate continuous production at an oilfield 301 even when faced with an undesirably high GVF for a substantial portion of the wells see 375, 377, 380 and 390 of FIG. 3).

Figure 3:
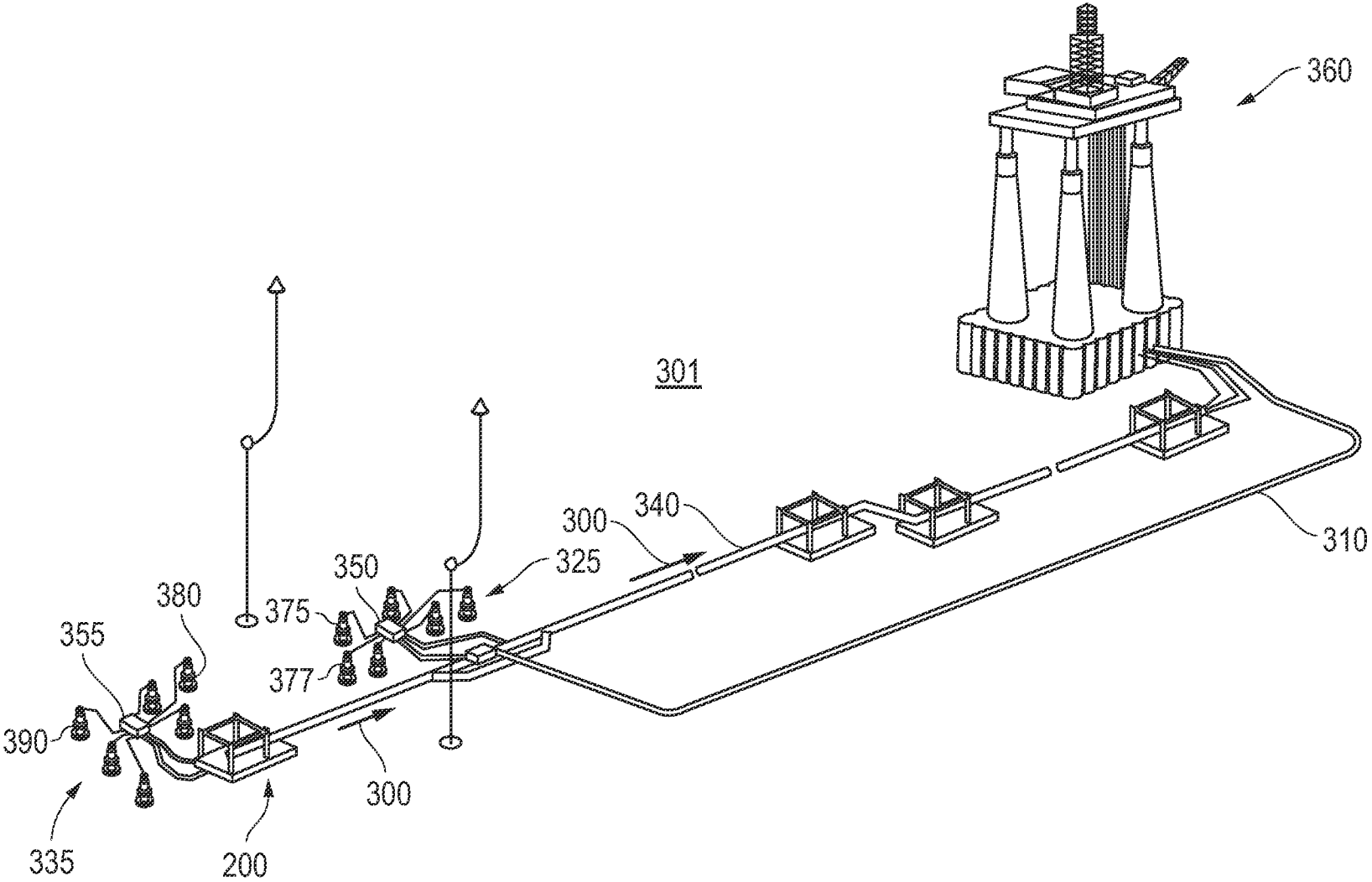
FIG. 3 is an overview depiction of a subsea oilfield taking advantage of the subsea pump system of FIG. 2B.

Referring now to FIG. 3, an overview depiction of a subsea oilfield 301 is shown taking advantage of subsea pump systems 200 as illustrated in FIG. 2B. In this particular layout, multiple well clusters 325, 335 are coupled to manifolds 350, 355. This oilfield 301 includes a conventional offshore platform 360 from which subsea operations may be directed. In this particular example, bundled water and production lines 340 and bundled electrical/hydraulic lines 310 may run along the seabed between the platform 360 and the cluster locations.

The oilfield 201 accommodates embodiments of the subsea pump systems 200 described hereinabove to help facilitate and promote production of fluids from the clusters 325, 335 of wells 375, 377, 380, 390 (see arrows 300). In spite of the potential for elevated GVF from the well clusters 325, 335 on the whole, as described hereinabove, the GVF that is encountered by the pump 250 of each system 200 remains below about 60% (see FIG. 2B). Indeed, the GVF exposed to the pump 250 may remain at such low percentages even where the GVF of production exceeds 90% at an individual well 375, 377, 380, 390, cluster 325, 335 or the overall field 301. Thus, gas lock from a gas bubble may be avoided and a sufficient pressure differential maintained for continuous pumping aid for circulating production fluids to the platform 360).

Figure 4B:
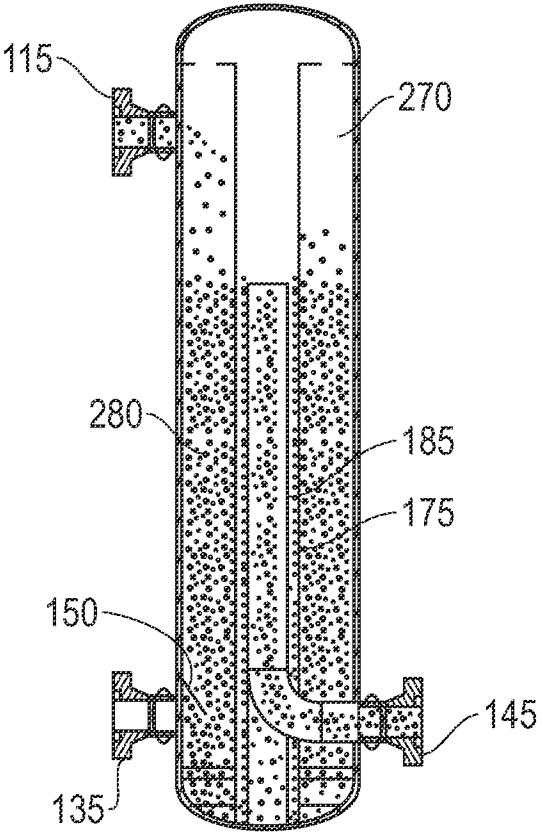
FIG. 4B is a cross-sectional side view of the splitter assembly of FIG. 4A during pumping operations following an initial startup period.
Figure 4A:
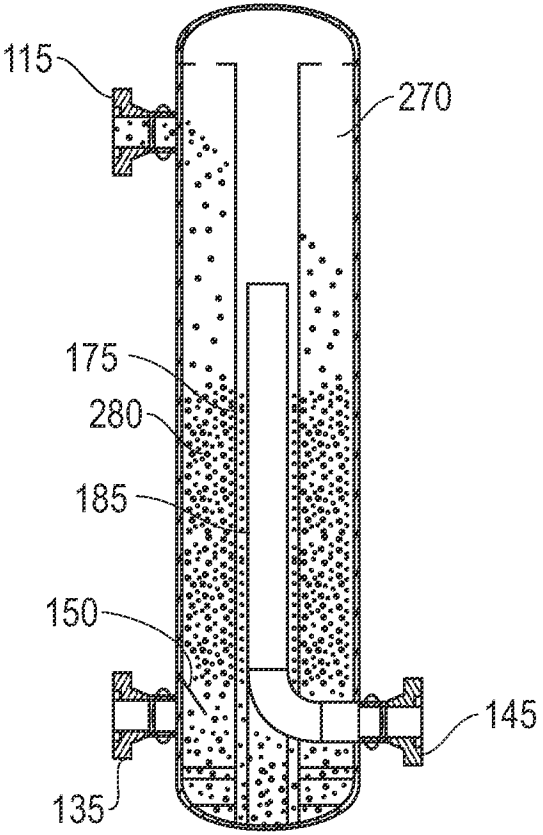
FIG. 4A is a cross-sectional side view of the splitter assembly of FIG. 1 at a start-up of pumping operations.

Referring now to FIG. 4A, a cross-sectional side view of the splitter assembly 100 of FIG. 1 is shown at a start-up of pumping operations. Notice that as production fluid enters through the inlet 115, the comparatively large volume of the assembly 100 and overall housing 110, immediately allows for the falling of the liquid fraction 280. Similarly, the gas fraction 270 is at the top of the assembly interior in the form of a gas cap.

Continuing with reference to FIG. 4A, recall that the depiction is of a period following start up of a dead, non-producing production line. Therefore, jumping ahead to the circulatory exit at the production outlet 145 reveals only gas fraction, consistent with the non-production initially at hand. However, following start-up of the pump 250 of FIG. 2B, for example via external priming if necessary, the influx of production fluid occurs as indicated with the liquid fraction 280 falling to the bottom of the assembly 100. By the same token, a gas compressor may be coupled to the piping in advance of the inlet 115 to increase the liquid fraction 280 entering the assembly 100. This may be by way of a separate discrete compressor between the splitter assembly 100 and the pump 250 or the pump 250 may be a liquid tolerant compressor with pump functionality.

Recall that the liquid fraction 280 is allowed to pass below the outer tube 175 to reach a Weir barrier in the form of an inner tube 185 where the level rises until reaching the top of the inner tube 185. With added reference to FIG. 4B, this top level may be reached and the liquid begin to spill over and into the inner tube 185 to reach the production outlet 145. Notice at this spill over location (e.g., 187 of FIG. 2A), the gas 270 and liquid 280 fractions begin to remix together as the production fluid heads toward the outlet 145.

Recall also that the deflector 150 has encouraged sand and other debris to remain with this portion of the circulating liquid fraction 280. Thus, as the liquid is produced through the production outlet 145 sand and other debris may be produced as well. This is in contrast to the portion of the liquid fraction 280 that alternatively leaves the recirculation outlet 135 for benefit of decreasing GVF at the pump 250 of FIG. 2B.

Figure 5A:
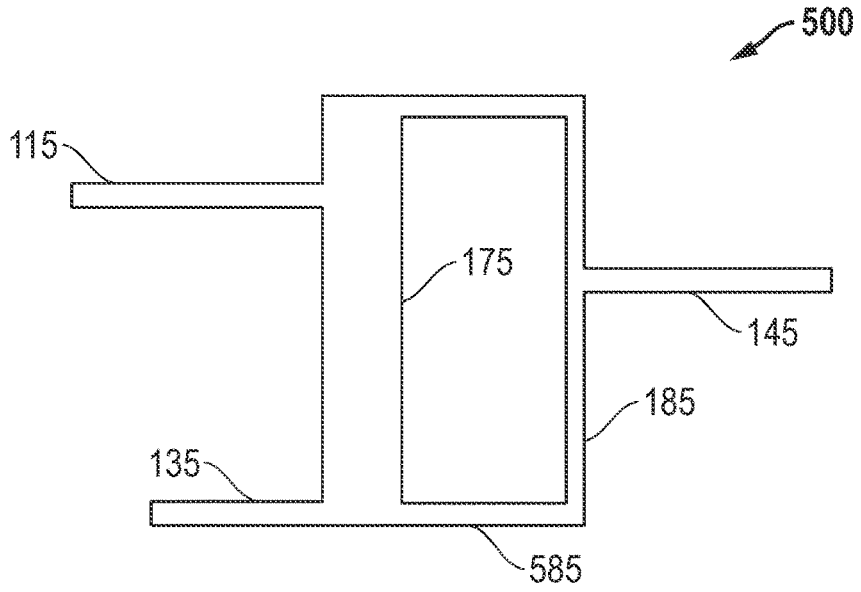
FIG. 5A is a schematic representation of an alternate embodiment of a splitter assembly for a subsea pump system.

Referring now to FIG. 5A, a schematic representation of an alternate embodiment of a splitter assembly 500 for a subsea pump system 200) is illustrated (see also FIG. 2B). In this embodiment, a Weir type of configuration is attained through the unique arrangement of conventional piping components. For example, the inlet 115 delivers production fluid to a conventional large volume chamber, which serves as the outer tube 175. Liquid fraction in this outer chamber 175 may be allowed to flow out through an exit line 585 and over to another chamber 185, which serves the inner tube function detailed hereinabove. Specifically, this chamber 185 may serve as a Weir type of barrier against which liquid fraction may rise until spilling over into the exit line the production outlet 145). As with the embodiments described above, this is where the gas and liquid production fractions will recombine. Meanwhile, the liquid fraction exiting the outer chamber 175 is also presented the option of exiting through the recirculation outlet 135 for ultimately routing to a pump 250 to promote continued function (see FIG. 2B).

Figure 5B:
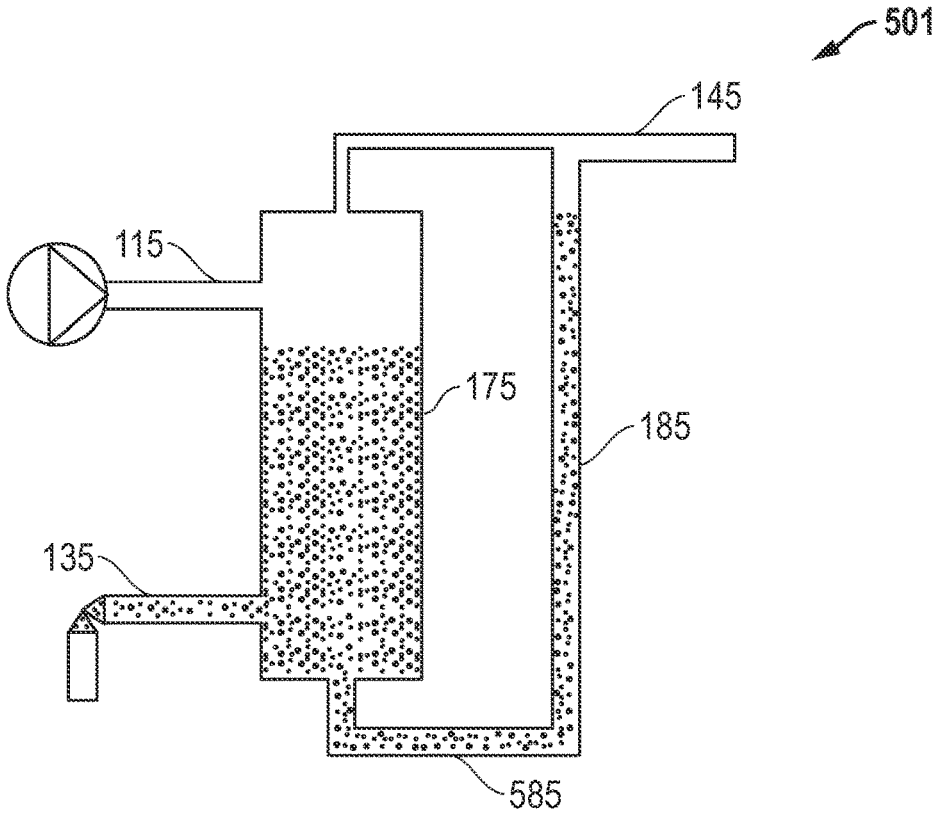
FIG. 5B is a schematic representation of another alternate embodiment of a splitter assembly for a subsea pump system.

Referring now to FIG. 5B, with added reference to FIG. 2B, a schematic representation of another alternate embodiment of a splitter assembly 501 for a subsea pump system 200 is shown. This embodiment is largely the same as that illustrated in FIG. 5A. However, in this embodiment, the gas fraction exits the outer tube/chamber 175 through a pipe at the top and the liquid fraction for production is allowed to similarly exit from below the outer tube/chamber 175. This more restricted or choked manner of circulation may help avoid sand circulation through the gas fraction and increase pressure in the liquid fraction below to encourage sand production ultimately toward the outlet 145. Additionally, in this embodiment, the architecture of the inner chamber 185 directs the liquid fraction for production to recombine with the gas fraction at a higher level, near a terminal end of the chamber 185 where the production outlet 145 is now located.

Figure 6:
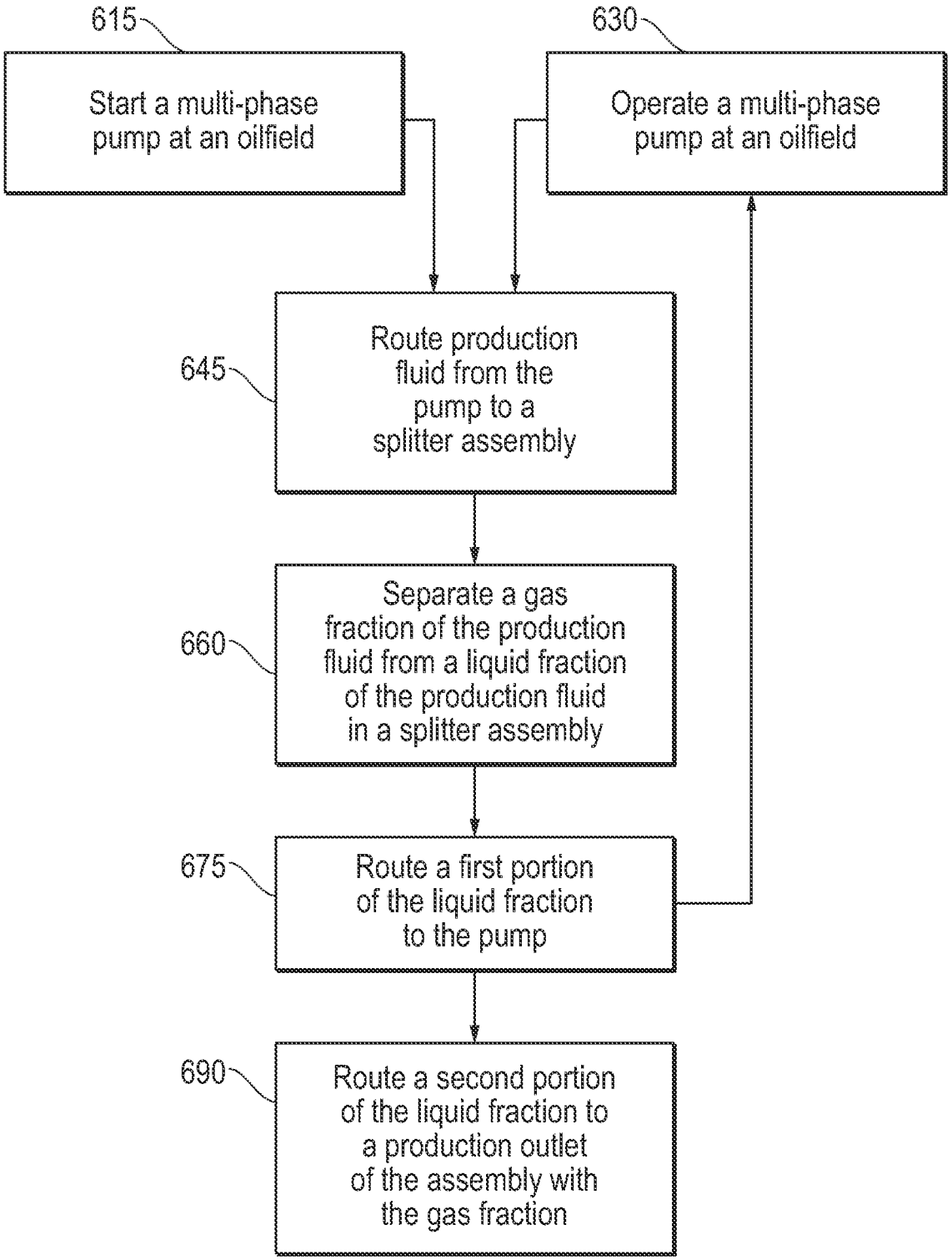
FIG. 6 is a flow-chart summarizing an embodiment of utilizing a splitter assembly of a subsea pump system to startup and maintain production flow of higher GVF fluids.

Referring now to FIG. 6, a flow-chart summarizing an embodiment of utilizing a splitter assembly of a subsea pump system to startup 615 and maintain 630 production flow of higher GVF fluids is illustrated. As indicated at 645 production is routed from the multiphase pump to a splitter assembly utilizing unique architecture. Due to this architecture, the gas fraction of the production fluid may be split from the liquid fraction as noted at 660 with a portion of the liquid fraction being made available for circulation back to the pump (see 630). Note that from startup at 615, to gas separation at 660 and liquid fraction routing at 675, a dead well may be started by effectively producing a gas cap at the splitter assembly as a means of reducing pressure at the wellhead to begin flowing. Regardless, throughout, the GVF of the production fluid that is actually pumped by the pump may be kept to a minimum to enhance pump function and avoid gas locking. As indicated at 690, the remainder of the liquid fraction may then be combined with the gas fraction and produced.

Embodiments described hereinabove include a system and techniques for cost effective production assistance when faced with higher GVF fluids. These embodiments allow for continuous pumping to aid production from subsea oilfield wells whether the production fluid is predominantly liquid or has transitioned to higher GVF production. Thus, more costly gas lift equipment and techniques may be avoided.

Further, in circumstances where higher GVF has lead to gas lock and dead wells, the equipment and techniques detailed herein may be retrofitted onto such systems to restart pumping and attain effective production.

The preceding description has been presented with reference to presently preferred embodiments. However, other embodiments and/or features of the embodiments disclosed but not detailed hereinabove may be employed. For example, for sake of brevity, components herein may be referenced by particular shape terminology such as "tube". However, this is not meant to infer that such a component have a particular tubular shape or is tubular at all. Indeed, a variety of differently shaped chambers, housings, etc. may be utilized in this regard. Similarly, the embodiments herein are described primarily with reference to a single splitter assembly. However, such assemblies may be arranged in series within the same system. Furthermore, persons skilled in the art and technology to which these embodiments pertain will appreciate that still other alterations and changes in the described structures and methods of operation may be practiced without meaningfully departing from the principle and scope of these embodiments. Furthermore, the foregoing description should not be read as pertaining only to the precise structures described and shown in the accompanying drawings, but rather should be read as consistent with and as support for the following claims, which are to have their fullest and fairest scope.

We claim:

1. A splitter assembly at an oilfield accommodating a well containing multiphase production fluid, the assembly comprising:

an inlet in fluid communication with a multiphase pump at the oilfield;

an outer chamber coupled to the inlet for receiving multiphase fluid of the well from the pump with a gas fraction of the fluid over a liquid fraction of the fluid;

a recirculation outlet at a lower portion of the chamber to direct a first portion of the liquid fraction to the pump to reduce a gas volume fraction of the multiphase fluid;

an inner chamber in fluid communication with a lower portion of the outer chamber to attain a second portion of the liquid fraction, where the second portion of the liquid fraction pools in the outer chamber until reaching a spill over location and flows into the inner chamber; and a production outlet in fluid communication with the spill over location, the production outlet configured to receive the gas fraction and the second portion of the liquid fraction exiting the inner chamber for production.

2. The splitter assembly of claim 1, wherein the outer chamber is an outer tube and the inner chamber is an inner tube.

3. The splitter assembly of claim 2, wherein the inner tube is disposed within the outer tube.

4. The splitter assembly of claim 1, wherein the inner chamber is located adjacent the outer chamber, the assembly further comprising:

a gas fraction pipe at the top of the chambers for gas fluid communication between the chambers; and a liquid fraction pipe at the bottom of the chambers for liquid fluid communication between the chambers.

5. The splitter assembly of claim 4, wherein the gas fraction pipe is configured to restrict gas fluid flow exiting the outer chamber to the inner chamber and increase pressure in the inner chamber for circulation of particulate therefrom with the liquid fraction.

6. The splitter assembly of claim 1, further comprising a deflector in housing adjacent the recirculation outlet to direct particulate away from the recirculation outlet.

7. The splitter assembly of claim 6, further comprising a cup shaped base below the recirculation outlet to direct particulate toward the inner chamber.

8. A pump system at a subsea oilfield, the system comprising:

a multiphase pump for pumping a production fluid of a subsea well at the oilfield; and a splitter assembly with an inlet in fluid communication with the pump for attaining the production fluid therefrom, the splitter assembly having a production outlet for producing a first portion of a liquid fraction of the production fluid and a recirculation outlet for diverting a second portion of the liquid fraction back to the pump for increasing a pressure differential across the pump;

wherein the first portion of the liquid fraction pools in an outer chamber of the splitter assembly until a level of the first portion of the liquid fraction reaches a spill over location and flows into an inner chamber and to the production outlet.

9. The pump system of claim 8, further comprising a mixer in fluid communication with the recirculation outlet and the pump for mixing the second portion of the liquid fraction with production fluid from the well in advance of pumping thereof.

10. The pump system of claim 8, further comprising a gas compressor in fluid communication with and located between the multiphase pump and the splitter assembly to compress the production fluid from the pump in advance of reaching the splitter assembly.

11. A method of pumping a multiphase fluid from a well at an oilfield, the method comprising:

advancing the fluid from the well to a multiphase pump at the oilfield;

routing the fluid from the pump to a splitter assembly at the oilfield;

separating a gas fraction of the fluid from a liquid fraction of the fluid within the splitter assembly;

pooling the liquid fraction at a bottom of an outer chamber of the splitter assembly with the gas fraction thereabove, the liquid fraction flowing into an inner chamber of the splitter assembly, the inner and outer chambers in fluid communication with one another;

recirculating a first portion of the liquid fraction from the splitter assembly back to the pump for increasing a pressure differential across the pump, the first portion of the liquid fraction exiting the splitter assembly through a recirculation outlet in the outer chamber; and allowing the liquid fraction to pool within the outer chamber until the liquid reaches a spill over location that causes a second portion of the liquid fraction to enter the inner chamber and flow toward a production outlet of the splitter assembly.

12. The method of claim 11, further comprising producing a gas cap within the assembly to lower wellhead pressure at the well and initiate production.

13. The method of claim 11, wherein the multiphase fluid from the well is of a gas volume fraction in excess of about 60%.

14. The method of claim 11, further comprising:

combining the gas fraction with the second portion of the liquid fraction; and producing the combined gas and second portion liquid fractions via the production outlet.

15. The method of claim 11, wherein the outer chamber in fluid communication with the inner chamber is adjacent thereto, the fluid communication is through the bottom of the outer chamber, and the method further comprising employing a wall of the inner chamber to facilitate the pooling of the liquid.

16. The method of claim 15, further comprising advancing the second portion of the liquid fraction from the pooled liquid to a level at the top of the inner chamber for spill over thereinto.

17. The method of claim 14, wherein the combining of the gas fraction with the second portion of the liquid fraction occurs at the spill over location.

18. The method of claim 11, further comprising starting the pump with a priming fluid prior to the advancing.

19. The method of claim 18, wherein the priming fluid is selected from a group consisting of a chemical injection liquid, methanol and monoethylene glycol.

* * * * *